US005731114A

United States Patent [19]

Evenstad et al.

[11] Patent Number: 5,731,114

[45] Date of Patent: Mar. 24, 1998

[54] METHOD OF IMAGING AN ELECTROSTATIC MASTER TO FORM A PRINTING PLATE THROUGH THE USE OF A COLOR LASER COPIER IN BLACK MODE

[76] Inventors: Damon F. Evenstad, 617 Meadow Dr., Glenview, Ill. 60025; Steven C. Evenstad, 442 Green Bay Rd., Kenilworth, Ill. 60043

[21] Appl. No.: 537,012

[22] Filed: Oct. 2, 1995

[51] Int. Cl.[6] ..... G03G 13/26

[52] U.S. Cl. ..... 430/49; 430/48; 358/246; 399/1

[58] Field of Search ..... 430/49, 300, 48; 358/296; 399/151, 1

[56] References Cited

U.S. PATENT DOCUMENTS

| | | | |
|---|---|---|---|
| 5,212,030 | 5/1993 | Figov | 430/49 |
| 5,304,443 | 4/1994 | Figov | 430/49 |
| 5,405,723 | 4/1995 | Rhodes et al. | 430/49 |

*Primary Examiner*—Peter S. Wong
*Assistant Examiner*—Derek J. Jardieu
*Attorney, Agent, or Firm*—Walter C. Ramm

[57] ABSTRACT

Processes, products and inventive uses for improved gray scales in pictorial content of monochrome printed matter and involving a color laser copier (30). An exemplary process presents a subject image (14) to a laser color copier, supplies an electrostatic printing plate (20) to the copier, and introduces the subject image directly to the plate as a transfer image (14') by operating the copier. The process confers superior gray scale capability to the plate and prepares the plate, as later mounted on a printing press (40), to produce printed matter (43) wherein printed image (14") corresponds to the subject image and is characterized by improved gray scale. An exemplary product, as an article of manufacture, is a printing plate with the directly-introduced transfer image. An inventive use is use or operation of the copier directly to make—from subject image on its copy board (31)—the transfer image on the printing plate. The invention obviates many time-intensive steps and need for considerable equipment of prior art practices, in instant printing establishments and elsewhere, for making the transfer image.

7 Claims, 4 Drawing Sheets

METHOD OF IMAGING AN ELECTROSTATIC MASTER TO FORM A PRINTING PLATE THROUGH THE USE OF A COLOR LASER COPIER IN BLACK MODE

BACKGROUND OF THE INVENTION

This invention relates to improvements in printing, products for printing, and printed matter. The invention particularly involves color copier apparatus for imparting superior gray scale capability to electrostatic printing plates as well as producing, by such plates, printed matter with gray scale improvements relative to printed matter presently available according to the state of the art in the instant printing branch of the printing business/trade.

A long-standing interest in and unfulfilled need for gray scale improvements in monochrome printed matter—especially for pictorial content—are well known by instant printing establishments and their suppliers. These establishments serve customers who need and expect smaller printing runs (say, a range of 25–5,000 copies/order), local or "neighborhood" ambience, and lower prices, thus differentiating them from larger printing plants. A typical instant printing establishment may have less sophisticated and less expensive equipment than a large printing plant. But, notably, a substantial number of instant printing establishments have a color copier on premises.

Production of pictorial content of monochrome printed matter in an instant printing establishment by prior art practice commonly involves a complex, expensive photography process with two cameras and with dedicated camera and darkroom space in house (or some photography steps out-sourced to a service bureau). An original for a customer's order is made—typically, as a "paste-up"—with line copy and pictorial content. The customer may have supplied material for the pictorial content as, for example, a snapshot. Pictorial content of and for this original must present as a discrete screened image. And before the original be assembled for the content must be photographed by a first camera, with a dot-forming screen between the material and the camera, to provide a first photograph. In the darkroom this first photograph is chemically developed to make the discrete screened image and, also, exposed to yellow light to enhance mid-tones of the image's gray scale.

Typically, this screened image is assembled with line copy to constitute a whole paste-up or other original. The whole original is then photographed by a second camera onto an electrostatic printing plate. This second camera's output is a plate with a transfer image of the whole original. Small imperfections are removed from the now-made plate with a deletion pen. Finally, the plate is sensitized and ready for mounting on a printing press. As mistake happens at any step of the process, all subsequent steps must be repeated.

The electrostatic printing plate as utilized in the prior art process is a widely available article of commerce. Such a plate is sheet-like, flexile, thin (say, 5 mils thick), nonmetallic and rectangular, and has two opposed sides or surfaces. One of the sides is the active or "emulsion" side. The transfer image, as made by the second camera, is on the active side.

Thus, at least pictorial content of monochrome printed matter, as produced by a transfer image of a printing plate according to the prior art process, lacks the benefit of more sophisticated equipment or process technologies as may be availed of in larger printing plants. Despite the screen, gray scales of printed matter from such a plate are often characterized by limited numbers of less well differentiated tones, and perceived as at least relatively less satisfactory or impressive.

Apparatus, methods and uses effectively to meet the unfulfilled need for better gray scale in the pictorial content of monochrome printed matter are distinct desiderata.

SUMMARY OF THE INVENTION

In this summary

"plate" means an electrostatic printing plate of the type noted under Background Of The Invention.

"monochrome" means a single color which, as appearing in printed matter, often is but need not be black.

"gray scale" means, in presentation or depiction of a multi-colored subject in monochrome printed matter, appearance of the subject's colors as different tones or shades of the monochrome color, as may be objectively characterized in terms of tone densities or "dpi" (dots per inch), or in terms of halftone screen (lines), and as may be subjectively perceived as attractive as and to the extent the tones appear consistent with those colors.

"subject image" means a presentation or depiction, including a multi-color presentation or depiction, as available for copying by photography, xerography or otherwise.

"copier" means an equipment of the type employing coherent electromagnetic phenomena and powders directly to make, on sheet stock, a color copy of a multi-color subject image, and is operable in black mode.

"copy sheet" means the piece of sheet stock, such as paper, upon which a copier is to make or makes a direct copy, but in any case not a plate.

The general object of this invention is to meet the long-standing interest in and unfulfilled need for gray scale improvements. Within the general object, specific objects include: apparatus in aid of the general object; printing plates with superior gray scale capability; preparation of printing plates and production of printed matter, including pictorial content, with said improvements, by novel methods and by products not heretofore used for the purpose; and, convenient and less costly production of higher quality printed matter.

In summary, for these objects, this invention has product, method and inventive-use aspects pertaining to copiers, plates, transfer images on and printed matter made with plates, and pictorial content of the printed matter. According to the invention, a transfer image is introduced to and made on a plate, by a copier, directly from an original presentation or depiction, and, in effect, with a fine or small dot pattern for pictorial content. The invention advantageously dispenses with or obviates the many time-intensive steps and expensive equipment of the prior art, including two cameras, screen, screened image, and darkroom equipment, work, space and yellow light.

The methods of the invention relate to imparting superior gray scale capability to printing plates and making printed matter with improved gray scales. An exemplary method has steps of supplying a plate to the copier for direct copying, presenting a subject image at the copier's copy board, and introducing the subject image to the plate by operating the copier as if the subject image were to be copied onto a copy sheet. This introduction immediately generates on the plate a transfer image corresponding to the subject image. The plate, as removed from the copier, is utilized to make printed matter.

As to apparatus and inventive uses, the invention contemplates embodiments of copiers organized and adapted to impart superior gray scale capability to plates, and use of copiers to prepare and to produce printed matter with such plates. Despite wide distribution, popularity, and usage of copiers, such uses appears neither to be known, nor available, nor in public practice.

REFERENCE NUMERALS

Figure 1A:
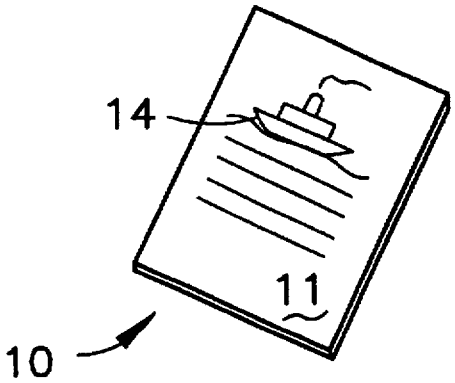
FIG. 1A sketches an article with a subject image, such as a color photo, with pictorial content. The pictorial content is upward.
Figure 1B:
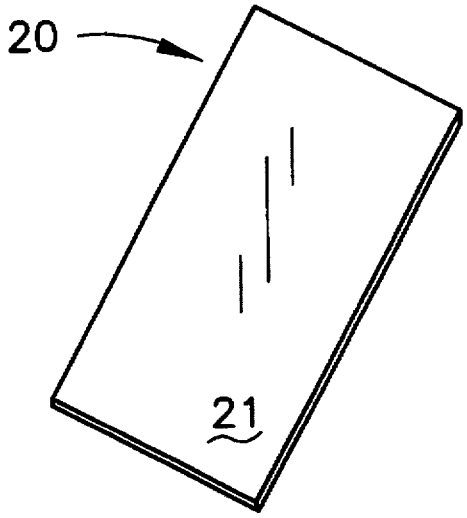
FIG. 1B is a perspective view of a fresh printing plate.

In the drawings and in this specification, reference numerals identify structures, parts, elements, features, aspects and other matters of or with reference to this invention:

Numeral 10 is a subject-image article.

In and of article 10

11 is the face or obverse side.

12 is the back or reverse side

14 is a subject image on face 11.

Numeral 20 is an electrostatic printing plate.

In or with reference to plate 20

21 is the first or active side or surface.

14' is a transfer image corresponding to image 14.

Numeral 30 is a color copier.

Of copier 30

31 is the copy board.

32 is the "operate" button.

33 is the cover.

34 is an interior copy site or chamber.

35 is an exemplary tray comprising site 34.

36 indicates an entry path to site 34.

37 indicates an exit path from site 24.

38 locates the black mode selector.

39 is the drum.

Numeral 40 is components comprising a printing press.

Of or with reference to press 40

41 is the plate cylinder.

42 is the blanket cylinder.

43 is the ink rollers.

44 is printed matter on paper as produced by press 40.

45 is the impression cylinder.

46 is the sheet-transfer cylinder

41' is printed image content in matter 44 and corresponding to images 14 and 14'.

DESCRIPTION OF PREFERRED EMBODIMENTS AND BEST MODES

Products, methods and uses of this invention, in their several aspects, including structure and operability, and according to these descriptions, represent preferred embodiments and best modes of the invention. In some such aspects, an embodiment or use may represent an improvement of or with reference to printing plates and apparatus, and printed matter, as otherwise known to the art.

FIGS. 1A–6 illustrate articles and processes of and apparatus with which to practice the present invention. FIG. 1A shows article 10 as planar and image 14 with pictorial content on side 11. FIG. 1B presents plate 20 in fresh condition and with active side 21 upward. For purposes of present descriptions, and for example, plate 20 is a paper electrostatic master as supplied by AM International, Inc., 1800 West Central Road, Mount Prospect, Ill. (reorder number 83-6-104976); and, copier 30 of FIGS. 2–3 may be the product identified as "Canon Laser Copier 700" and supplied by Ambassador Office Products, Inc., 425 North Martingale, Schaumburg, Ill.

Figure 2:
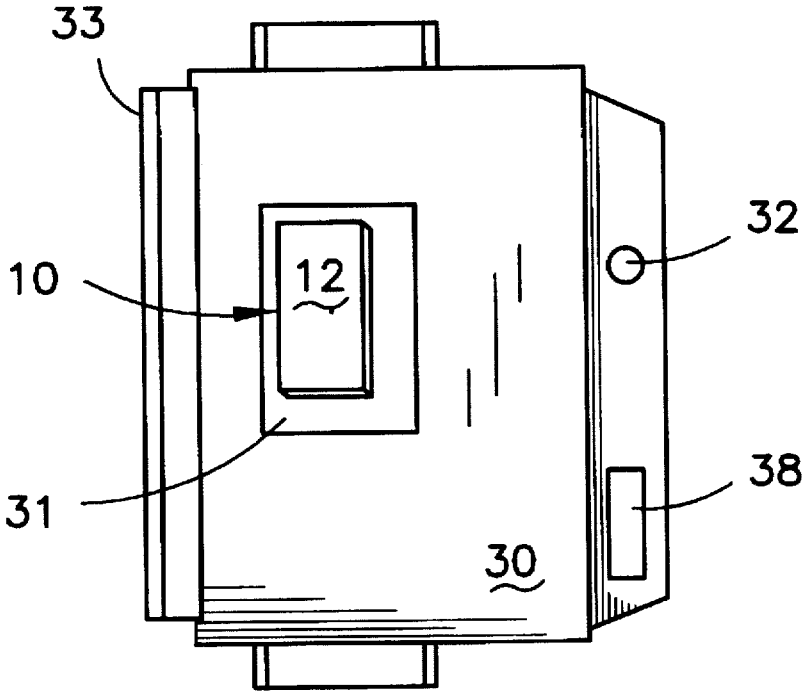
FIG. 2 is a plan view of a copier. The cover is raised to disclose the copy board, and the article of FIG. 1A is on the copy board.

FIG. 2 shows article 10 supplied to copier 30, that is, positioned by an operator on copy board 31 with image 14 downward and toward the copy board. Button 32 and control 38 enable the operator to work the copier, and, as necessary, to select its black mode.

Figure 3:
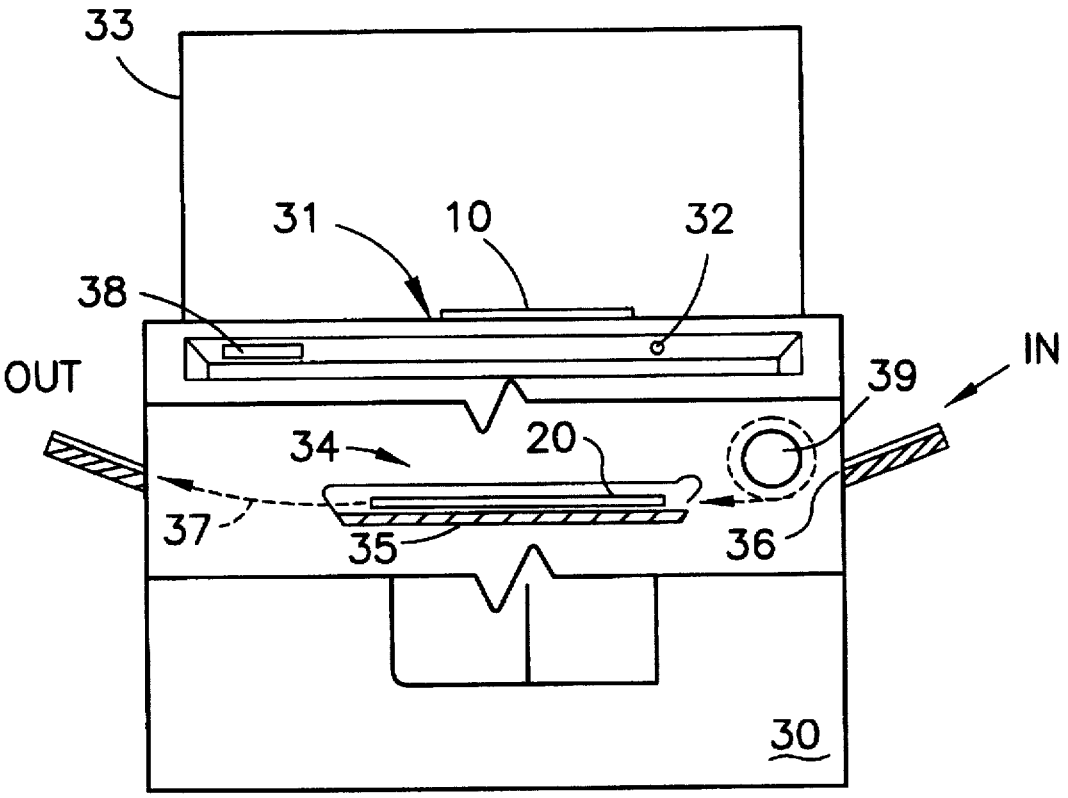
FIG. 3 sketches the front elevation of the copier of FIG. 2. A portion of the front is removed to show an internal operational site for a copy sheet, exemplary routes to and from the site, a drum on the route to the site, and the plate of FIG. 1B at the site.

In FIG. 3, plate 20 is presented to copier 30, and, specifically, at site 34. Side 21 is upward. The plate is positioned so the copier may operate to copy image 14 onto side 21 in the same way as if the plate were a copy sheet. Site 34 is the by-pass tray which the copier provides for handling copy sheets of unusual size, is accessed via path 36, and, in any case, is sized and oriented so that the plate at the site is operatively positioned as to the article on board 31. Drum 39 is up-path of site 34 in path 36. As the plate's transit of path 36 is mechanically implemented and sequenced from operation of button 32, the plate makes at least one pass of and around the drum. The "in"/"out" arrows indicate the general course of the plate.

Figure 4:
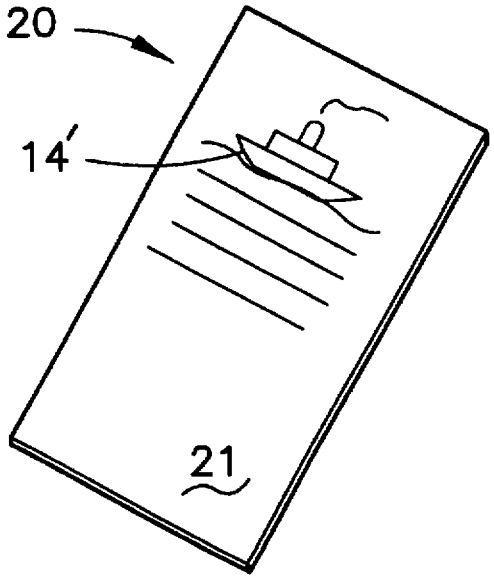
FIG. 4 is a perspective view of the plate of FIG. 1B after the copier of FIG. 3 was operated as to it and as then removed from the copier. Its upward first side exhibits a transfer image.

Accordingly, with copier 30 in black mode, and article 10 and plate 20 in their respective positions (FIGS. 2–3), operation of button 32 serves to introduce image 14 to side 21 as image 14' (see FIG. 4). Subsequent removal of the plate may be as sequenced from operation of the button and mechanically implemented so the plate, as transported from site 34, transits path 37 and exits the copier. Or, the copier may be organized to enable the operator manually to take or extract the plate from or at a point up-path of site 34.

FIG. 4 illustrates plate 20 after it has been removed from copier 30 and become an image-transfer plate. Side 21 is a substrate for and carries toner or similar materials for and providing transfer image 14' as directly introduced from article 10 and which, typically and as shown, is visible. This direct introduction differs sharply with the earlier two camera/darkroom/screened image technique. This plate and transfer image combination may well be an article of manufacture.

Figure 5:
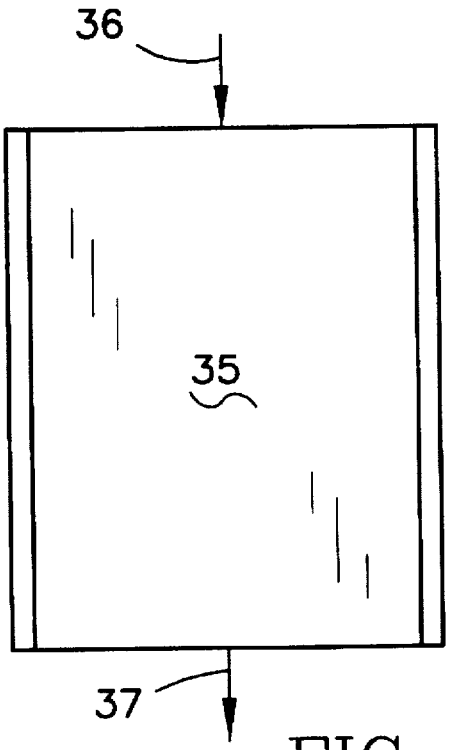
FIG. 5 is a plan view of an oversize tray of comprising the copy site of a copier such as the copier of FIG. 3.

FIG. 5 suggests large or oversize tray 35 to implement (with other components) a copy site, such as site 34, for a large printing plate, otherwise like a plate 20, that is of suitable size to receive a transfer image as introduced from a printing job where an original presentation, such as article 10, has area substantially larger than jobs heretofore customarily done with such a plate of conventional size. Exemplary width and length dimensions of tray exceed 11×17 inches.

In other apparatus and product aspects, this invention is directed to a laser copier or equivalent adapted to operate only in black mode. Concerning the phrase "in black mode", notice may be taken that, apart from this invention, at least some versions of a laser copier, such as copier 30, make color separations for printing purposes. Each such separation is on one of four sheets or plates; is for one of four specific colors such as magenta (red), cyan (blue), yellow and black; and, as made, presents a partial transfer image in black tones for one of the colors. In this specification, for purposes of this invention and a laser copier adapted to operate only in black mode, the phrase means the mode for making a whole or complete image, such as image 14', corresponding to an image 14, in black and on a single copy sheet.

Figure 6:
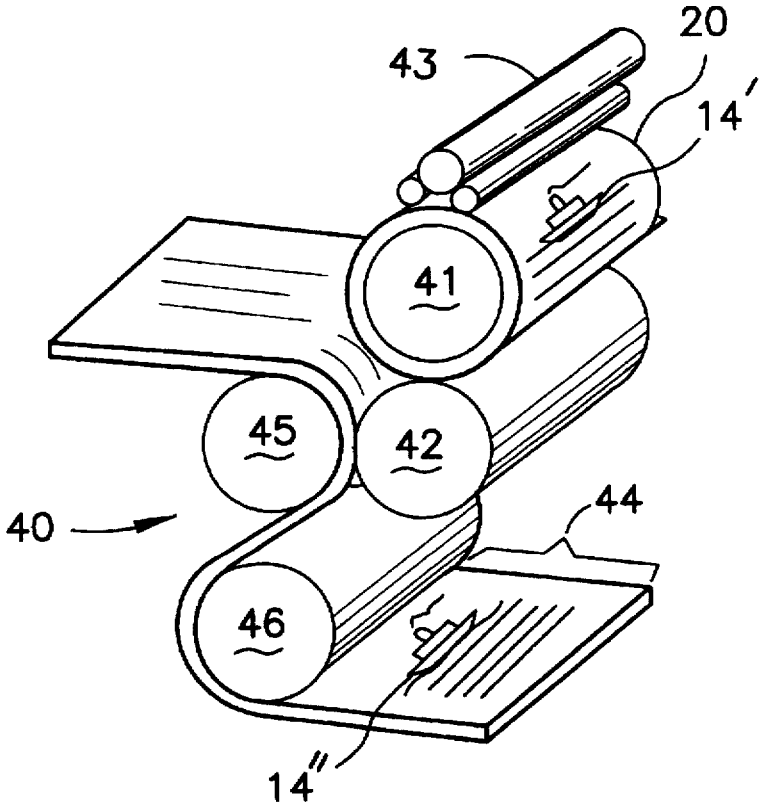
FIG. 6 sketches components of a conventional offset printing press. The plate of FIG. 4 on the plate cylinder of the press.

Referring to FIG. 6, plate 20—with image 14' and having been sensitized—is mounted on cylinder 41 with image 14' outward, and press 40 is producing printed matter 44 on paper. Cylinder 42, rollers 43, printing fluid, and other usual features and parts of the press co-operate in the production. Cylinder 41 is in clockwise rotation, and cylinder 42 is in counter-clockwise rotation.

Figure 7:
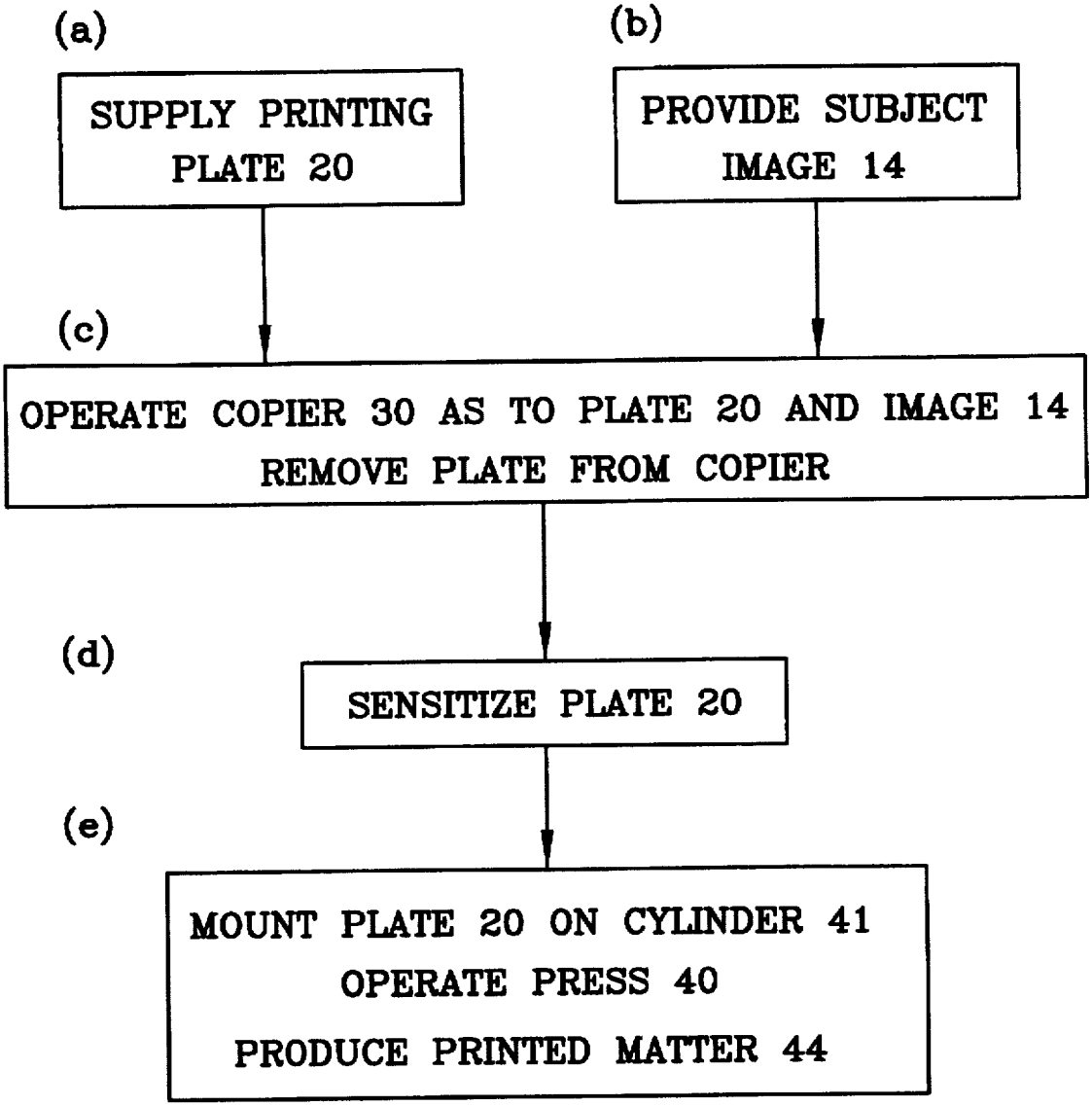
FIG. 7 diagrams methods for (i) initial preparation to impart superior grey scale capability to a printing plate and (ii) utilization of the plate to produce gray scale improvements in printed matter.

As to methods of the invention, FIG. 7 charts versions of a first method to impart or confer superior gray scale capability to plate 20. That is, with copier 30 in black mode, steps of (a) supplying the plate to the copier at site 34 (FIG. 3), (b) presenting article 10 to the copier at copy board 31 (FIGS. 2–3), and (c) introducing image 14 to the plate by operating the copier, by button 32, as to the site and copy board thereby directly to make image 14' on side 21 (FIG. 4). Steps (a) and (b) are interchangeable, must be accomplished during one or the same time period, and may be virtually simultaneous. Step (c) is sequential of the later of step (a) or step (b), that is, after the time period. Also, prior to step (a) the plate is to be fresh or unused (FIG. 1), image 14 should present several colors, and image 14' is positive as to image 14. This first method may be characterized as an initial preparation process for the plate, and the thus-prepared plate, as removed from the copier, is an image-transfer plate.

This first method is capable of practice at one location, such as a service bureau or copy shop, with a copier and a supply of printing plates, for making image-transfer plates which are then transported and used elsewhere.

FIG. 7 charts versions of an additional exemplary second method, that is, a method for producing printed matter 44 with improved gray scales. Thus, subsequent to the initial preparation process of steps (a), (b) and (c), and removal of initially-prepared plate 20 from copier 30, steps of: (d) sensitizing side 21 and (e) mounting the plate on and then operating press 40 (FIG. 6). This second method may be characterized as utilization of the plate.

Other particulars of the second method: step (d) involves conventional application of a liquid, in step (e) plate 20 is as in FIG. 6, and the sequence of images—14 to 14' to 14"—is positive to positive to positive.

Inventive use of this invention—as a novel and unexpected with reference well known and widely used copier apparatus—relates to and accomplishes special use and operation of a copier, such as copier 30 or black-mode equivalent, in black mode. The inventive use serves directly to generate from a subject image, such as image 14, on the copier's copy board, a transfer image corresponding to the subject image on the active side of a plate, such as image 14' on side 21 of plate 20, as if the plate were a copy sheet.

Apart from the several product, methods and use aspects of this invention described in this specification, other embodiments and methods for preparing or making a printing plate by directly introducing a subject image to a printing plate as a corresponding transfer image on the plate are within the spirit and scope of this invention.

What is claimed is:

1. A method of imaging an electrostatic master comprising an emulsion layer on a paper substrate, for making monochrome printed matter derived from a subject image, and by means of a color copier having a black mode of operation, comprising within a time period the steps of disposing the subject image as for copying by the color copier, disposing an electrostatic master to receive powder toner from the color copier on the emulsion layer of the electrostatic master, and selecting the black mode of operation; and, after the time period, the step of operating the color copier in the black mode to direct a toner deposit from the copier corresponding to the subject image toward the emulsion layer and onto the electrostatic master, and to cause the electrostatic master thereafter to exit the color copier.

2. A method of preparing an electrostatic master with a nominal halftone screen to make monochrome printed matter derived from a subject image with pictorial content and whereby the pictorial content of the printed matter is characterized by an effective halftone screen substantially superior to the nominal halftone screen, comprising steps of first, selecting a color laser copier with a black mode of operation;

then, within a time period, steps of disposing the subject image as for copying by the selected copier, disposing the electrostatic master to receive toner from the selected copier on the emulsion layer of the electrostatic master, and selecting the black mode of operation of the selected copier; and, after the time period, operating the color copier in the black mode to direct a toner deposit from the copier corresponding to the pictorial content of the subject image onto the emulsion layer of the electrostatic master.

3. Use of color laser copier apparatus in black mode, in association with a subject image and an electrostatic master having an emulsion side, to introduce to the emulsion side a lithographic transfer image corresponding to the subject image and comprising toner deposited by the apparatus, and in which use the subject image is presented to the apparatus as for copying and the electrostatic master is supplied to the apparatus as for receiving a copy on the emulsion side.

4. Use of color laser copier apparatus according to claim 3, where the presented subject image includes pictorial content, and the use includes operation of the apparatus with reference to the presented subject image and supplied electrostatic master and imparts to the electrostatic master capability for making a printed image corresponding to the subject image and whereof the pictorial content is characterized by an effective halftone screen of at least 200 line.

5. Use of a color laser copier and toner substances from the color laser copier, in association with a subject image and an electrostatic master having an emulsion side, to introduce to the emulsion side a toner-defined transfer image corresponding to the subject Image where the subject image is presented to the color laser copier as for copying, and the electrostatic master is supplied to the color laser copier as for receiving a copy on the emulsion side.

6. Use of a color laser copier in black mode of operation in association with a subject Image comprising pictorial content and an electrostatic master having an emulsion side and characterized by a nominal halftone screen, where the subject image is presented to the color laser copier as for copying, the electrostatic master is supplied to the color laser copier as for receiving a copy on the emulsion side, and the color laser copier is operated with reference to the presented subject image and the supplied electrostatic master, to introduce to the emulsion side a transfer image for making a printed image corresponding to the subject image and whereof the pictorial content is characterized by an effective halftone screen that is substantially superior to the nominal halftone screen of the electrostatic master.

7. Use of a color laser copier according to claim 6 where the electrostatic master is characterized by a nominal halftone screen of 120 line, and the use imparts to the Introduced transfer image capability for making a printed image corresponding to the subject Image and whereof the pictorial content is characterized by an effective halftone screen of at least 200 line.

* * * * *